United States Patent [19]

Saito et al.

[11] Patent Number: 4,508,266

[45] Date of Patent: Apr. 2, 1985

[54] METHOD OF CHANGING COLOR OF PAINTS FOR AN ELECTROSTATIC COATING MACHINE

[75] Inventors: Eiiji Saito, Kamakura; Shoji Aizawa; Michio Mitsui, both of Yokohama; Tomohiko Miyata, Tokyo; Masayuki Kuroda, Kawasaki, all of Japan

[73] Assignee: Ransburg Japan, Ltd., Tokyo, Japan

[21] Appl. No.: 503,170

[22] Filed: Jun. 10, 1983

Related U.S. Application Data

[62] Division of Ser. No. 287,818, Jul. 28, 1981, Pat. No. 4,422,576.

[30] Foreign Application Priority Data

Aug. 4, 1980 [JP] Japan ..... 55-106955

[51] Int. Cl.[3] ..... B05B 5/02

[52] U.S. Cl. ..... 239/3

[58] Field of Search ..... 239/3, 693, 703, 112, 239/113, 120, 121

[56] References Cited

U.S. PATENT DOCUMENTS

| | | | |
|---|---|---|---|
| 2,784,114 | 3/1957 | Miller | 239/703 X |
| 3,155,539 | 11/1964 | Juvinall | 118/11 |
| 3,348,774 | 10/1967 | Wiggins | 239/124 X |
| 3,450,092 | 6/1969 | Kock | 118/703 |
| 3,674,205 | 7/1972 | Kock | 239/112 X |
| 3,857,513 | 12/1974 | Wiggins | 239/112 X |
| 3,870,233 | 3/1975 | Wilhelm et al. | 239/112 X |
| 4,212,266 | 7/1980 | Payne et al. | 239/693 |
| 4,232,055 | 11/1980 | Shaffer | 239/3 X |
| 4,380,321 | 4/1983 | Culbertson et al. | 239/112 X |

*Primary Examiner*—John J. Love
*Assistant Examiner*—Mary F. McCarthy
*Attorney, Agent, or Firm*—Oblon, Fisher, Spivak, McClelland & Maier

[57] ABSTRACT

An electrostatic coating machine comprises a coating machine main body having a rotary atomizing head and a cleaning shroud, a plurality of color change valve mechanisms for feeding paints and cleaning fluids to the rotary atomizing head, a first change-over valve provided at a position close to the rotary atomizing head, paint feed passages respectively connected to each of the color change valve mechanisms and selectively communicating with the rotary atomizing head by way of the first change-over valve, a drain passage for recovering the drainage from the cleaning shroud and the first change-over valve, a discharging section for forcively discharging the drainage from the drain passage, and a second change-over valve provided in the midway of the drain passage communicating from the cleaning shroud to the discharging section. The cleaning shroud, the first and second change-over valves are disposed in a high voltage section that takes the same potential as that for the rotary atomizing head when a high voltage is applied to the rotary atomizing head, whereas each of the color change valve mechanisms and the discharging section are disposed on the side of the ground. The method of changing color of paints using the foregoing electrostatic coating machine is also disclosed.

2 Claims, 4 Drawing Figures

METHOD OF CHANGING COLOR OF PAINTS FOR AN ELECTROSTATIC COATING MACHINE

This is a division of application Ser. No. 287,818, filed July 28, 1981, now U.S. Pat. No. 4,422,576.

BACKGROUND OF THE INVENTION

1. Field of the Invention

This invention relates to an electrostatic coating machine and a method of changing color of paints thereby, and more particularly, relates to an electrostatic multicolor coating machine for coating a plurality of articles with paints of different colors, which is capable of rapid cleaning of a rotary atomizing head, paint feed and drain passages and the like after the end of coating the preceeding article with a preceeding or last color and, accelerating the coating preparation for the succeeding article with a succeeding or next color, as well as a method of changing color of paints in such a coating machine.

For coating articles, for example, continuously sent on a conveyor arranged at a predetermined interval, it is required to change the color of paints in the electrostatic coating machine where different coating colors are to be applied on one article and the other article succeeding thereto. Such color change has conventionally been carried out by a method of bringing a cleaning shroud around a rotary atomizing head after the coating has been completed for the preceeding article, supplying cleaning fluids consisting of air, thinner and the like from a cleaning source to clean the paint feed passage, the rotary atomizing head and the like, thereby forcing the used cleaning fluid or drainage to flow into the cleaning shroud and then discharging the fluid by way of a drain pipeway. The paint of the succeeding color has also been supplied in the same manner as above by feeding the paint to the rotary atomizing head.

However, in changing the paint color by the prior art method referred to above, the cleaning fluid and the paint have to be supplied at low speed and low pressure in small flow rate so that the cleaning liquid or the paint should not scatter from the rotary atomizing head nor overflow from the shroud to the outside to otherwise result in circumferential contaminations. Thus, such a prior art method has a defect in that much time is taken for the cleaning and the coating preparation.

Further, in a case where the paint which contains metal powder such as of aluminum (hereinafter referred to as a metallic paint) is used for the coating, metal powder remained in the drain pipe causes to ground the high voltage to the earth by bridging the same in the drain pipe which produces electro-conductor therein. Thereby, sparks are generated to cause the danger of fire accidents. Therefore, the drain pipe has to be cleaned by way of the cleaning shroud in the prior art method, thus resulting in further extended time being required therefor.

2. Object of the Invention

Accordingly, an object of this invention is to provide an apparatus and a method capable of rapidly changing the color of paints in an electrostatic coating machine.

Another object of the present invention is to provide an apparatus and a method in which the paint feed passages are divided into a major portions from color change valve mechanisms in close proximity to a rotary atomizing head and the remaining minor portion and in which cleaning and coating preparation can be carried out portionwise for such divided portions, the rotary atomizing head and the drain passage successively.

A further object of this invention is to provide an apparatus and a method capable of decreasing those portions which the cleaning fluid is to be fed at a low pressure in a low flow rate as much as possible, and thereby feeding the cleaning fluid at a high pressure in a great flow rate for the major portion of the paint feed passage which forms the most part to be applied cleaning fluid.

A still further object of this invention is to provide an apparatus and a method of changing paint color in an electrostatic coating machine, capable of preventing the cleaning fluid or the paint from overflowing out of the cleaning shroud and also capable of preventing the drain pipe from generating an electro-conductivity by bridging the metal contained therein in a case of using metallic paint as a succeeding color.

SUMMARY OF THE INVENTION

The foregoing objects can be attained in accordance with the present invention by:

An electrostatic coating machine according to this invention comprises a coating machine main body having a rotary atomizing head which is applied with a high voltage and a cleaning shroud reciprocatingly provided to move between a position surrounding the rotary atomizing head and retracted therefrom, a plurality of color change valve mechanisms for feeding paints and cleaning fluids to the rotary atomizing head, a first change-over valve provided at a position close to the rotary atomizing head, paint feed passages respectively connected to each of the color change valve mechanisms and selectively communicated with the rotary atomizing head by way of the first change-over valve, a drain passage for recovering the drainage from the cleaning shroud and the first change-over valve, a discharging section for forcively discharging the drainage from the drain passage, and a second change-over valve provided in the midway of the drain passage communicating from the cleaning shroud to the discharging section, wherein the cleaning shroud, the first change-over valve and the second change-over valve are disposed in a high voltage section that takes the same potential as that for the rotary atomizing head when a high voltage is applied to the rotary atomizing head, and each of the color change valve mechainsms and the discharge section are disposed on the side of the ground.

The method of color change in accordance with this invention involves changing the colors between the paint of a preceeding color for coating a preceeding article and the paint of a succeeding color for coating the succeeding article by using an electrostatic coating machine having a rotary atomizing head which is applied with a high voltage, a plurality of color change valve mechanisms for feeding paints and cleaning fluid to the rotary atomizing head and a cleaning shroud reciprocatingly provided to move between a position surrounding the rotary atomizing head and retracted therefrom, which comprises a first cleaning step of interrupting the high voltage after the coating has been completed for the paint of the preceeding color, feeding the cleaning fluid at a high pressure and in a great flow rate to the major portion of the paint feed passage and discharging the drainage without flowing into the cleaning shroud, a second cleaning step for feeding the cleaning fluid at a low pressure and in a low flow rate to the remaining color portion of the paint feed passage and the rotary atomizing head and discharging the drainage by way of the cleaning shroud, a first coating preparation step for feeding the paint of the succeeding color to the major portion of the paint feed passage and discharging the excess paint without flowing into the cleaning shroud, a second coating preparation step for feeding the paint of the succeeding color to the remaining minor portion of the paint feed passage and the rotary atomizing head and discharging the excess paint by way of the cleaning shroud, and a third cleaning step for cleaning a portion of the drain passage at a high pressure and in a great flow in order to prevent metal bridging from occurring in the drain passage of an electro-conductor by the excess paint upon application of a high voltage to the rotary atomizing head.

By the employment of the foregoing color change method, it is possible to reduce the intervals of articles to be coated which are continuously sent on a coating line. However, the reduction of the intervals of conveyored articles may sometimes cause so called "color spit", that is, a paint of a preceeding color scatters, before the end of the coating for the preceeding articles, to the succeeding articles to be coated, or vice versa, a paint of a succeeding color scatters, at the start of the coating for the succeeding articles, over the preceeding articles which has already coated with the preceeding color.

Accordingly, it is a supplemental object of this invention to provide a method of color change in an electrostatic coating machine capable of preventing such color spit.

In order to attain the above object, the following steps are provided in addition thereto, that is, a step of reducing the high voltage applied to the rotary atomizing head to a certain level before the end of the coating for the preceeding article with the paint of the preceeding color, and a step of applying a high voltage at a certain lower level to the rotary atomizing head after the end of the third cleaning step to put the succeeding coating in at the lower voltage level for a predetermined period of time, and thereafter increasing the voltage to the coating level.

The foregoing and other objects, features, as well as advantages of this invention will be made more clear by the appended claims and preferred embodiments to be described referring to the drawings.

DESCRIPTION OF PREFERRED EMBODIMENTS

Figure 1:
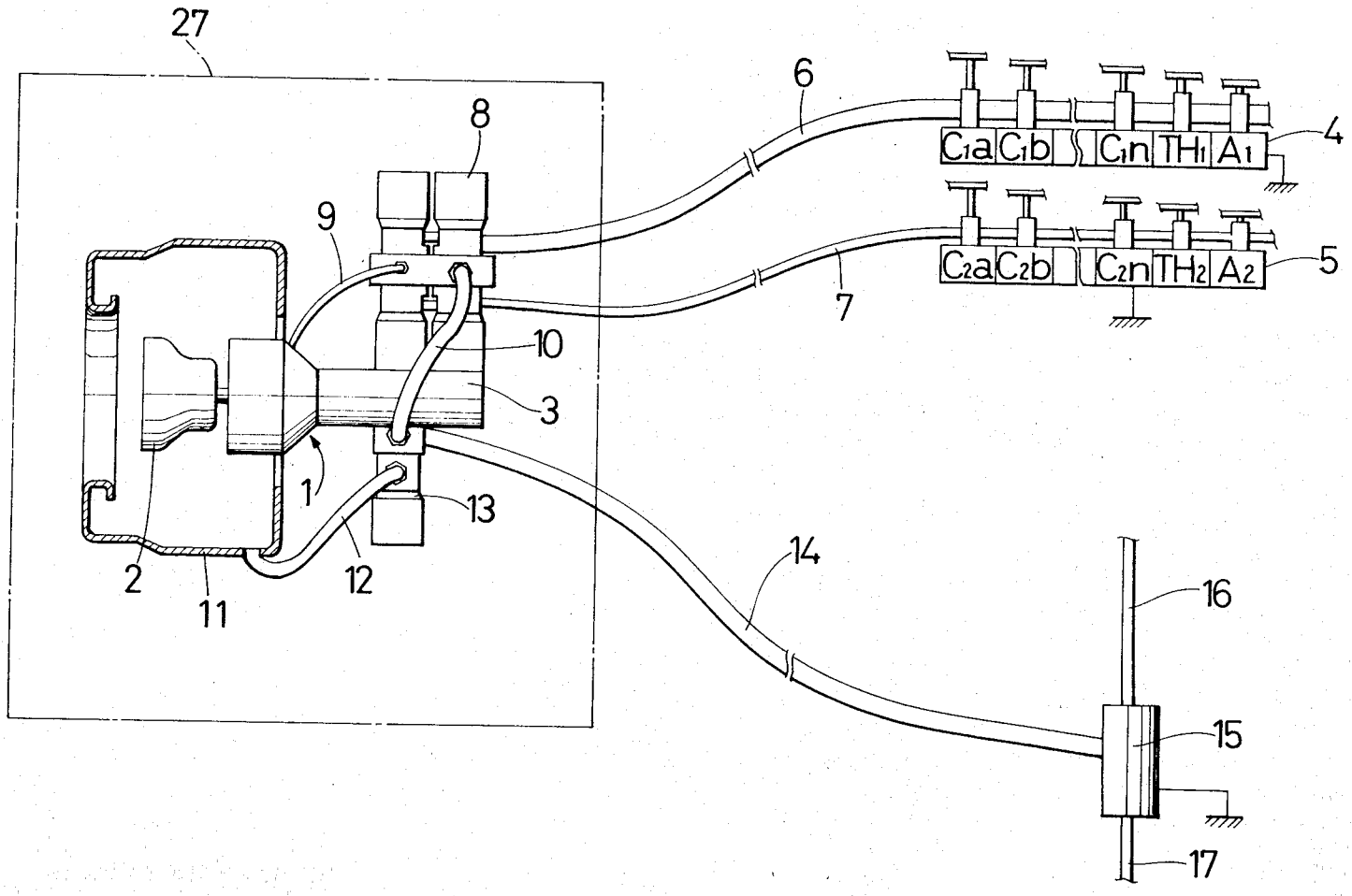
FIG. 1 is a schematic view showing a main part of an electrostatic coating apparatus.
Figure 2:
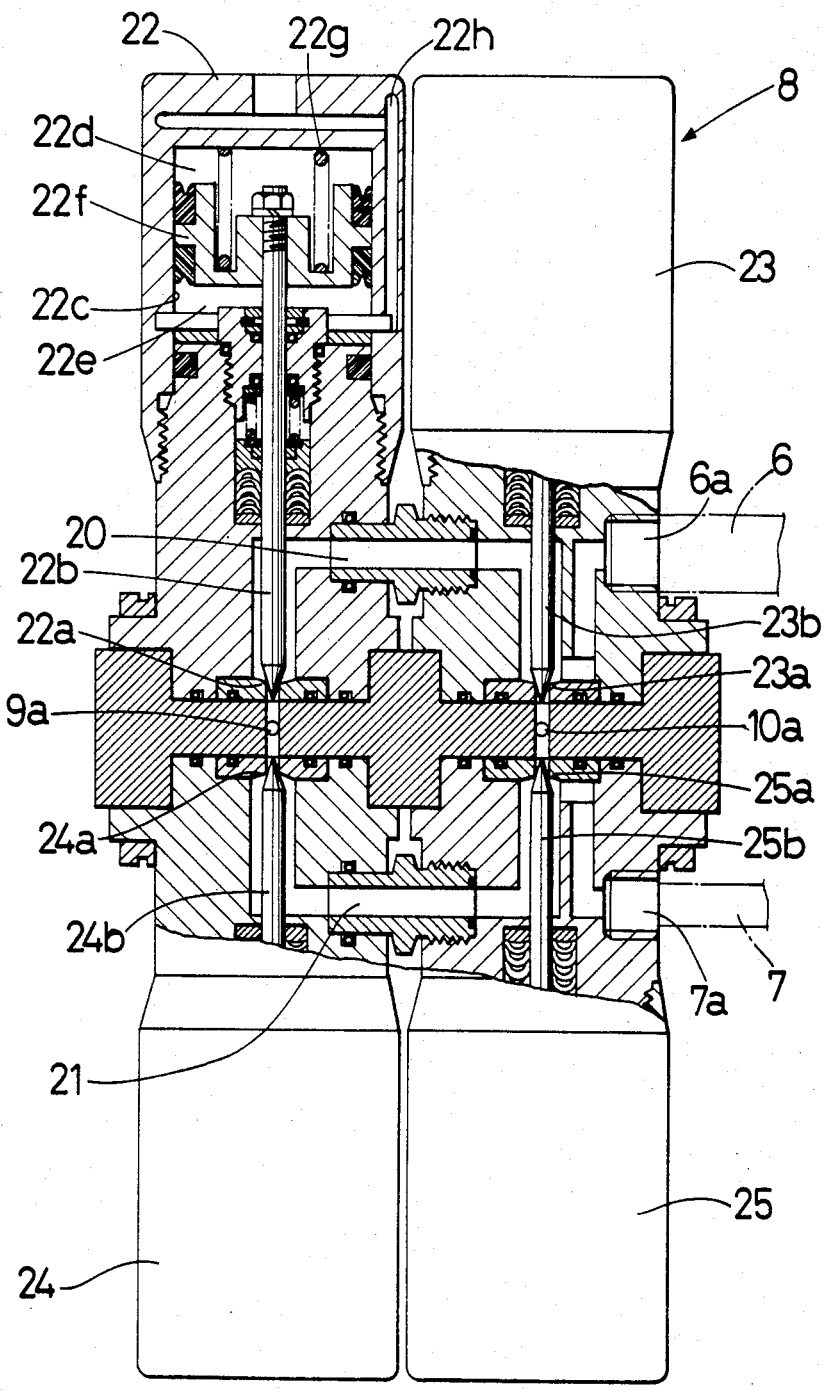
FIG. 2 is a vertical cross sectional view of a first change-over valve shown in FIG. 1.
Figure 3:
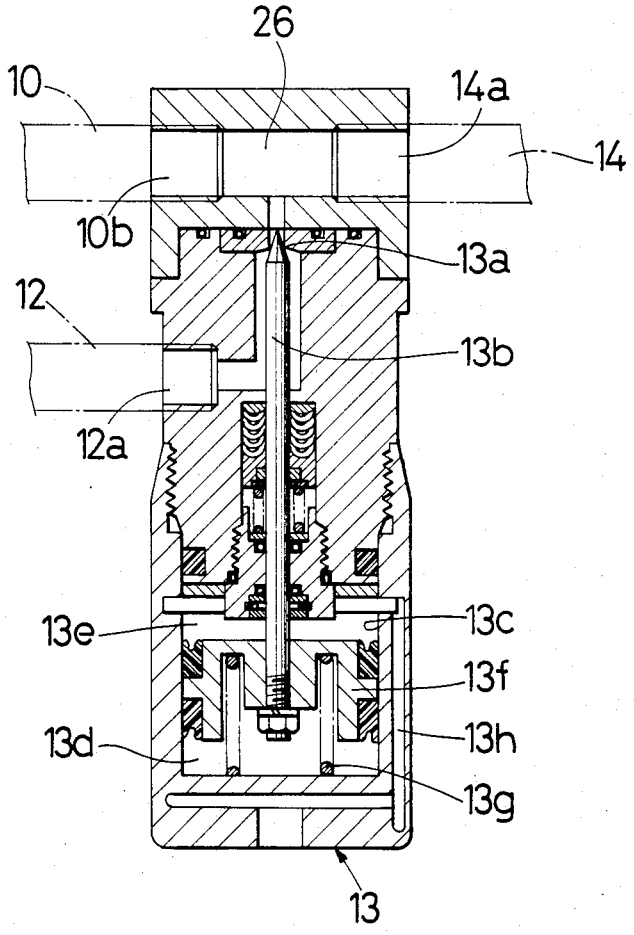
FIG. 3 is a vertical cross sectional view of a second change-over valve shown in FIG. 1.

Reference is then made at first for one embodiment of the apparatus according to this invention based on FIG. 1 to FIG. 3.

In FIG. 1, a coating machine main body 1 of an electrostatic coating apparatus is provided with a rotary atomizing head 2. The rotary atomizing head 2 is rotated at a high speed by an air motor 3 and is applied with a high voltage to electrostatically atomize the paint for coating articles to be coated (not shown). Paint is fed to the rotary atomizing head 2 from a paint supply tank (not shown) by way of a pair of color change valve mechanisms 4, 5. Each of the color change valve mechanisms 4, 5 has valve devices C1*a*, C1*b*, . . . C1*n* and C2*a*, C2*b*, . . . C2*n* respectively for independently feeding paints of color a through color n. Further, the valve mechanisms 4, 5 include air valve devices A1 and A2 and thinner vlave devices TH1 and TH2 respectively for feeding air and thinner, the both of which constitute cleaning fluids. Each of the valve devices A1, A2 and TH1, TH2 has such a structure as to be switcheable between the high speed and great flow rate (H) and the low speed and low flow rate (L). The first color change valve mechanism 4 is connected to a paint tank for non-metallic or solid paint and the second color change valve mechanism 5 is connected to a paint tank for metallic paint respectively in this embodiment.

The first and the second color change valve mechanisms 4, 5 are usually provided remote from the electrostatic coating machine main body 1, and the first and the second color change valve mechanisms 4, 5 are connected to the rotary atomizing head 2 by way of a paint feed passage. The paint feed passage consists of first and second paint feed pipes 6, 7 for feeding paints from the first and the second color change valve mechanisms 4, 5 respectively to a first change-over valve 8 which is provided in close proximity to the rotary atomizing head 2 and a third paint feed pipe 9 which is connected to the first change-over valve 8 so as to facilitate alternatively communicating the first and second feed pipes 6, 7 to the rotary atomizing head 2.

On changing the paint color in the electrostatic coating apparatus according to this invention, thinner and air are alternatively supplied to wash away or clean the paint passage and the rotary atomizing head 2. A drain passage is provided to the electrostatic coating apparatus for recovering the drainage after the cleaning. The drain passage has a first drain pipe 10 connected to the first change-over valve 8, a second drain pipe 12 connected to the cleaning shroud 11, and a third drain pipe 14 in communication with the first and the second drain pipes 10 and 12 by way of a second change-over valve 13. The cleaning shroud 11 is so designed as to be able by a reciprocal movement to turn toward and away from the rotary atomizing head 2 by an air cylinder (not shown). At the time of cleaning, the shroud may be advanced to a position surrounding the rotary atomizing head 2 to serve as a vessel for receiving the cleaning fluid discharged out of the rotary atomizing head 2.

The third drain pipe 14 is connected to an ejector 15 which has an air supply port 16 and a drain exhaust 17. By supplying air from the air supply port 16, drainage from the first drain pipe 10 or the second drain pipe 12 by way of the drain pipe 14 is forcibly suctioned by the drain exhaust 17. Since high voltage is applied to the rotary atomizing head 2 during coating by the electrostatic coating machine, each of the paint feed pipes 6, 7, 9 and the drain pipes 10, 12, 14 is formed with a hose, for example, made of polytetrafluoroethylene or the like having an excellent electrical insulation property and easy to clean. The first paint feed pipe 6 through which the solid paint is admitted has a greater diameter (for example, 4.8 mm inner diameter) in order to reduce the flow resistance in the flow passage and the second paint feed pipe 7 through which the metallic paint passes has a smaller diameter (for example, 3.2 mm inner diameter)

in order to suppress the bridging. Further, the third paint feed pipe 9 has similar diameter as that of the second paint feed pipe (for example, 3.2 mm inner diameter) so as to accelerate the flow rate of the cleaning fluid upon cleaning. Since the first change-over valve 8 is disposed at a position close to the rotary atomizing head 2, the first and the second paint feed pipes 6, 7 constitute the major portion of the paint feed passage, each having a length, for example, of about 1.5 m. The third paint feed pipe 9 constitutes the remaining minor portion of the passage, having a length, for example, of about 0.2 m. While on the other hand, each of the drain pipes 10, 12, 14 is made into larger diameter as much as possible in order to reduce the flow resistance in the flow passage.

FIG. 2 shows the cross section of the first change-over valve 8 that is constituted, in this embodiment, as a 4 port change-over valve which is assembled by four air-operated needle valves. The first change-over valve 8 is provided with a first supply port 6*a* to be connected with the first paint feed pipe 6, a second supply port 7*a* to be connected with the second paint feed pipe 7, and exit port 9*a* to be connected with the third paint feed pipe 9 and an exhaust port 10*a* to be connected with the first drain pipe 10 respectively. The first supply port 6*a* is connected with the exit port 9*a* by way of a first channel 10 and the second supply port 7*a* is connected with the exhaust port 10*a* by way of a second channel 21 respectively. The first change-over valve 8 comprises needle valves 22, 23, 24 and 25 which serve to selectively communicate the first feed pipe 6 and the second paint feed pipe 7 with the third paint feed pipe 9 and the first drain pipe 10 respectively. The needle valve 22 has a valve seat 22*a* formed in the channel 20 communicating to the exhaust port 9*a* and a needle 22*b* which moves toward and away from the valve seat 22*a*. One end of the needle 22*b* which is protruded into a plunger chamber 22*c* is connected to a plunger 22*f* which defines the plunger chamber 22*c* into chambers 22*d*, 22*e*. Within the chamber 22*d* is provided a spring 22*g* which urges the plunger 22*f* toward the needle 22*b* seating on the valve seat 22*a*. While on the other hand, to the chamber 22*e* is formed an opening for one end of an air channel 22*h* for supplying pressurized air to unseat the needle 22*b* from the valve seat 22*a* against the spring 22*g*. Other needle valves 23, 24 and 25 have quite the same structure as that of the needle valve 22, those parts which corresponding to the needle valve 22 are attached with corresponding suffixes and further explanation therefor being omitted.

The second change-over valve 13 is formed with a needle valve as shown in FIG. 3. Since the needle valve of the second change-over valve 13 also has the same structure as that in the needle valve 22 shown in FIG. 2, the details thereof are not repeated only depicting the corresponding parts thereof to those in the needle valve 22 with the corresponding suffixes. It should, however, be noted that the second change-over valve 13 comprises in its inside a communication channel 26 for always communicating the first drain pipe 10 with the third drain pipe 14, and ports 10*b*, 12*a*, 14*a* are formed to be connected respectively to the first drain pipe 10, the second drain pipe 12 and the third drain pipe 14. Accordingly, when pressurized air is fed by way of the air channel 13*h* to the inside of the chamber 13*e*, the needle 13*b* is unseated from the valve seat 13*a* to communicate the second drain pipe 12 with the third drain pipe 14.

While the second change-over valve 13 is constituted, in this embodiment, so as to join the first drain pipe 10 and the second drain pipe 12 into the third drain pipe 14, the first drain pipe 10 may be in direct communication with a drain tank (not shown). In this case, the communication channel 26 in the second change-over valve 13 may be connected to an air valve device and a thinner valve device additionally provided for supplying cleaning fluid to the third drain pipe 14.

The electrostatic coating machine according to this invention has the construction as outlined above, in which the air motor 3, the cleaning shroud 11, the first change-over valve 8 and the second change-over valve 13 are disposed in a high voltage area 27 (refer to FIG. 1) which is put at the same potential as the rotary atomizing head 2 when a high voltage is applied to the head 2, and the color change valve mechanisms 4, 5 and the ejector 15 are disposed on the side of the ground.

Figure 4:
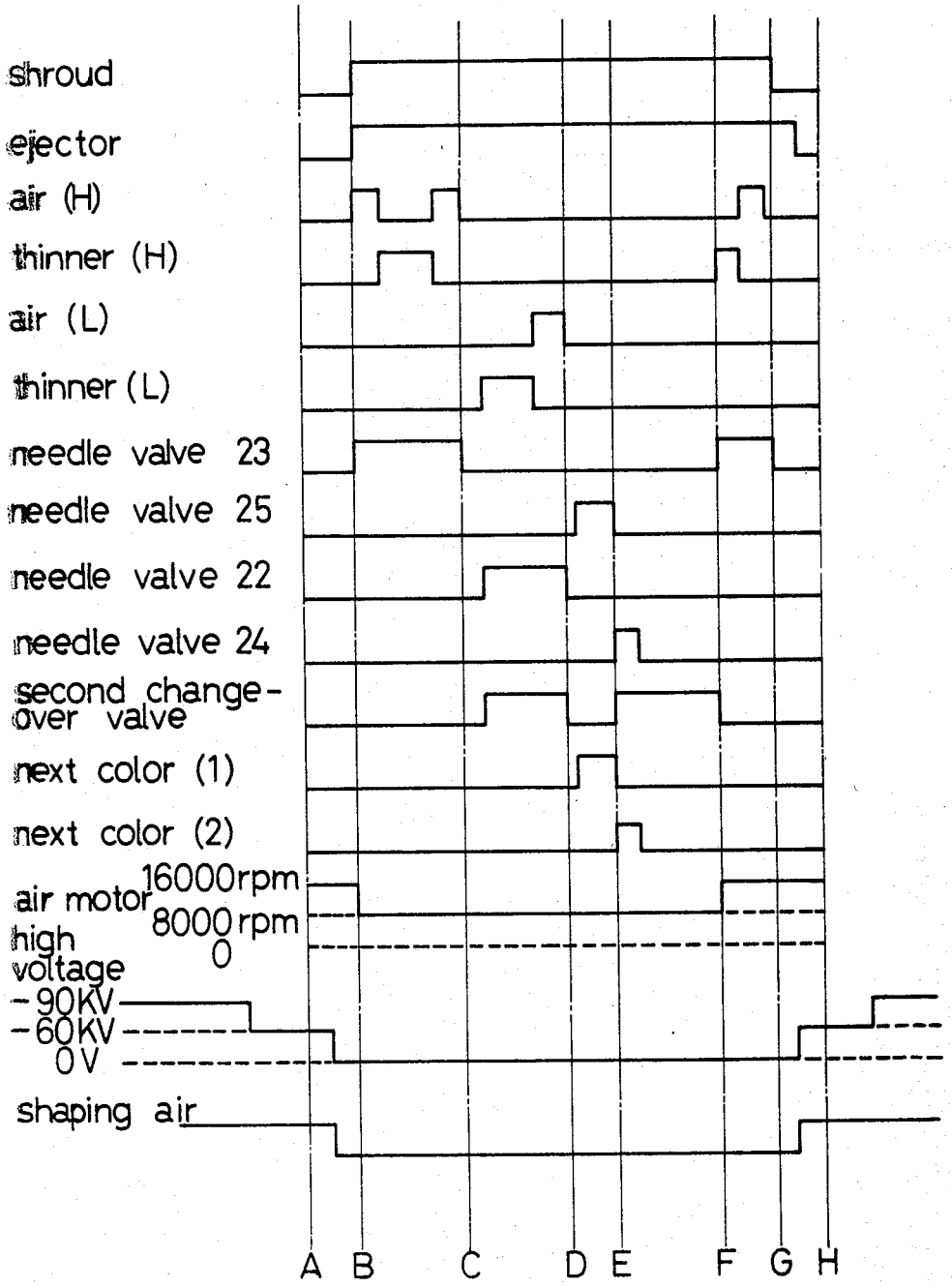
FIG. 4 is a time chart showing each of the steps in this invention.

The method of changing color in the electrostatic coating apparatus according to this invention is carried out by using the apparatus having the foregoing construction, and each of the steps of the method is to be explained in light of the time chart shown in FIG. 4. It is assumed here that preceeding articles to be coated have been coated with a paint of color a by opening the valve device C1*a* of the first color change valve mechanism 4 and opening the needle valve 22 of the first change-over valve 8 to feed a solid paint of the color a to the rotary atomizing head 2, while rotating the rotary atomizing head 2 at a high speed and applying a high voltage of a predetermined coating level (for example, −90 KV). In this state, the cleaning shroud is retracted and the rotary atomizing head 2 is exposed. Then, for coating the succeeding article that follows the preceeding article with the metallic paint of color b, the paint in the coating apparatus has to be changed from the color a to the color b after the end of the coating for the preceeding article and before the start of the coating for the succeeding article.

Thus, the high voltage of the coating level (−90 KV) is decreased to a lower level (for example, −60 KV) just before the end of the coating for the preceeding article (at point A in FIG. 4) and the thus reduced voltage is applied to the rotary atomizing head 2. This preliminary reduction in the coating voltage is taken for preventing from color spit wherein the paint of color a in the preceeding coating is deposited on the succeeding article. The step of reducing the coating voltage is necessary where the intervals of respective articles which are continuously sent on the coating line is to be minimized, which can be attained by the method of the present invention ensuring high speed color change. Therefore, such a voltage reduction may not be necessary where sufficient intervals are provided between each of the articles to be coated.

Where a predetermined period has elapsed after the end of the coating for the preceeding article, application of the high voltage (−60 KV) is cut off and, at the same time, feeding of shaping air for pattern forming is also stopped.

After the end of the coating referred to above, the first cleaning step is started between the points B–C of FIG. 4 in which the revolutional speed of the air motor is decreased from that for coating (for example, 16,000 rpm) to that for cleaning (for example, 8,000 rpm) and the cleaning shroud 11 is advanced. Further, the needle valve 22 is closed and the needle valve 23 is opened to switch the first paint feed pipe 6 into communication with the first drain pipe 10, and air is permitted to flow from the air supply port 16 through the ejector 15. Simultaneously, the valve device C1*a* of the first color change valve mechanism 4 is closed and air and thinner are supplied at a high pressure and in a great flow rate by alternately opening and closing the valve devices A1, TH1 (A1(H), TH1(H)). In this way, the first paint feed pipe 6 of the major part of the paint feed passage is cleaned at high speed in this first cleaning step. Since the needle valve 22 of the first change-over valve 8 is closed during this step, the cleaning fluid does not flow from the rotary atomizing head 2 into cleaning shroud 11 by way of the third paint feed pipe 9.

Then, the needle valve 23 is closed and the needle valve 22 is opened to switch the first paint feed pipe 6 into communication with the first paint feed pipe 9. At the same time, the second change-over valve 13 is actuated to communicate the second drain pipe 12 with the third drain pipe 14. Thus, air and thinner are supplied at a low pressure in a low flow rate (A1(L), TH1(L)) to the third paint feed pipe 9 and the rotary atomizing head 2 to clean the third paint feed pipe 9 and the rotary atomizing head 2, which is the second cleaning step between the points C–D. Since the length of the third paint feed pipe 9 is extremely shortened by the first change-over valve 8, cleaning for this minor portion of the paint feed passage can be finished in a relatively short period of time even at such a low speed. The cleaning fluid used for the cleaning of the third paint feed pipe 9 and the rotary atomizing head 2 flows into the cleaning shroud 11, attracted from the ejector 15 and discharged by way of the second drain pipe 12 and the third drain pipe 14 out of the system, whereby the fluid does not scatter from the rotary atomizing head 2 nor overflow out of the cleaning shroud 11 externally. By interrupting the supply of the cleaning fluid and closing the needle valve 22, the second cleaning step is completed.

Thereafter, the needle valve 25 is opened to communicate the second paint feed pipe 7 with the first drain pipe 10. Then, the valve device C2*b* of the second color change valve mechanism 4 is opened to fill the second paint feed pipe 7 with the succeeding paint of the color b (next color (1)), which is the first coating preparation step between D–E. The excess paint is discharged by way of the first drain pipe 10 and the third drain pipe 14 by the ejector 15. Even if the paint of the other color would deposit by a foreign reason in the inside of the second paint feed pipe 7, it can be discharged together with the excess paint. Thus, the inside of the second paint feed pipe 7 is now filled only with the paint of the next color.

Then, the needle valve 25 is closed and, at the same time, the needle valve 24 is opened to communicate the second paint feed pipe 7 with the third paint feed pipe 9, whereby the paint of the succeeding color (next color (2)) is fed to the third paint feed pipe 9 and the rotary atomizing head 2. This is the second coating preparation step shown as E–F. In this state, the second change-over valve 13 communicates the second drain pipe 12 with the third drain pipe 14 by the channel 26, whereby the excess paint flows out of the rotary atomizing head 2 is discharged externally from the cleaning shroud 11 by way of the second drain pipe 12, the third drain pipe 14 and ejector 15.

Further, the needle valve 24 is closed and the second change-over valve 13 is actuated to connect the first paint feed pipe 6 with the first drain pipe 10 and the third drain pipe 14. Air and thinner are fed alternately at a high pressure and in a great flow rate from the first color change valve mechanism 4 alternately (A1(H), TH1(H)) to clean the paint remaining in the first drain pipe 10 and in the third drain pipe 14, which is the third cleaning step between F–G. The third cleaning step is carried out for cleaning the third drain pipe 14. If the drain passage is left as it is not cleaned, metal powder contained in the metallic paint of the color b which flowed in each of the drain pipes in the first and the second coating preparation steps may cause bridging that renders the inside of the drain pipe electroconductive. In this bridging state, if a high voltage is re-applied to the rotary atomizing head 2 upon starting the coating for the succeeding articles, electrical current flows from the high voltage section by way of the third drain pipe 14 to the ejector 15 to generate sparkings resulting the danger of fire accidents. The third cleaning step is conducted for preventing such bridging. In the third cleaning step, the second drain pipe 12 is not cleaned. However, this portion is disposed in the high voltage section 27 so that no sparks should occur even if electrical current flows therethrough provided that the inside of the third drain pipe 14 has been cleaned. Then, by maintaining the second change-over valve 13 closed, after the third drain pipe 14 has been completely cleaned, no sparking accident must occur. The third cleaning step is also required even if solid paint is used as the succeeding paint color for preventing the paint from adhering on the third drain pipe 14. With each of the steps as stated above, color change process comprising the cleaning for the paint of the preceeding color and the charging for the paint of the succeeding color has been completed.

Now, the cleaning shroud 11 is retracted and air supply to the ejector 15 is stopped. A high voltage (−60 KV) is applied and the coating is started to the succeeding article at the point H. In order to prevent the paint of the succeeding color from depositing on the preceeding article for which the coating has already been completed, the high voltage to be applied to the rotary atomizing head 2 is not increased directly to the coating level (−90 KV) but once applied at a lower level (−60 KV) and thereafter, increasing to the coating level (−90 KV) in the same manner as conducted prior to the end of the coating for the succeeding article.

What is claimed as new and desired to be secured by Letters Patent of the United States is:

1. A method of changing color of paints to change between the paint of a preceeding color for coating a preceeding article and the paint of succeeding color for coating a succeeding article by using an electrostatic coating machine having a rotary atomizing head which is applied with a high voltage, a cleaning shroud reciprocatingly provided to move between a position surrounding said rotary atomizing head and retracted therefrom, a plurality of color change valve mechanisms for feeding paints and cleaning fluids to said rotary atomizing head, a first change-over valve provided at a position close to said rotary atomizing head, paint feed passages each of which consists of a major portion respectively connected to each of said color change valve mechanisms and to said change-over valve, and of a minor portion selectively communicated between said rotary atomizing head and said each major portion of said paint feed passages by way of said first change-over valve, a drain passage for recovering drainage from said cleaning shroud and said first change-over valve, a discharging section for forcively discharging the drainage from said drain passage, and a second change-over valve provided in the midway of said drain passage communicating from said cleaning shroud to said discharging section, which comprises:

a first cleaning step comprising interrupting the high voltage after the coating has been completed for the paint of the preceeding color, feeding the cleaning fluid at a high pressure and a great flow rate to the major portion of the paint feed passage and discharging the drainage of said cleaning fluid without flowing into the cleaning shroud;

a second cleaning step comprising feeding the cleaning fluid at a low pressure and in a low flow rate to the minor portion of the paint feed passage and the rotary atomizing head and discharging the drainage of said cleaning fluid by way of the cleaning shroud;

a first coating preparation step comprising feeding the paint of the succeeding color to said major portion of the paint feed passage and discharging a surplus of said paint without flowing into the cleaning shroud;

a second coating preparation step comprising feeding the paint of the succeeding color to the minor portion of the paint feed passage and the rotary atomizing head and discharging the surplus of said paint by way of the cleaning shroud; and a third cleaning step comprising cleaning a portion of the drain passage at a high pressure and in a great flow rate in order to prevent metal bridging from occuring in the drain passage owing to an electroconductivity of the surplus of said paint of the succeeding color upon application of a high voltage to the rotary atomizing head.

2. The method of changing color of paints according to claim 1, further including a step of reducing the high voltage applied to the rotary atomizing head to a certain level before the end of the coating for the preceeding article with the paint of the preceeding color and a step of applying high voltage at a certain lower level to the rotary atomizing head for a predetermined period of time after the end of said third step in order to prevent the paint of succeeding color from depositing on the preceeding article.

* * * * *